US007195291B2

(12) United States Patent
Kobayashi et al.

(10) Patent No.: US 7,195,291 B2
(45) Date of Patent: Mar. 27, 2007

(54) LOCKING DEVICE

(75) Inventors: Yasutomo Kobayashi, Yamato (JP); Kensuke Fujiwara, Yokohama (JP)

(73) Assignee: Nifco Inc., Yokohama (JP)

( * ) Notice: Subject to any disclaimer, the term of this patent is extended or adjusted under 35 U.S.C. 154(b) by 151 days.

(21) Appl. No.: 11/165,205

(22) Filed: Jun. 24, 2005

(65) Prior Publication Data

US 2006/0001270 A1 Jan. 5, 2006

(30) Foreign Application Priority Data

Jun. 30, 2004 (JP) ..... 2004-193351

(51) Int. Cl.
*E05C 5/02* (2006.01)
*E05C 19/00* (2006.01)

(52) U.S. Cl. ..... 292/57; 292/60; 292/300; 292/304; 292/DIG. 4

(58) Field of Classification Search ..... 292/18, 292/57, 59, 60, 62, 300, 304, 341.15, 341.17, 292/DIG. 4, DIG. 37, DIG. 46; 16/82
See application file for complete search history.

(56) References Cited

U.S. PATENT DOCUMENTS 1,907,625 A * 5/1933 Vogt ..... 70/100
2,497,425 A * 2/1950 Terry ..... 126/285 R
2,839,808 A * 6/1958 Zahodiakin ..... 411/551
2,922,211 A * 1/1960 Boyd ..... 411/551
3,169,293 A * 2/1965 Neuschotz ..... 411/552
3,178,213 A * 4/1965 Nelson ..... 292/18
3,179,457 A * 4/1965 Johnson ..... 292/195
4,207,655 A * 6/1980 MacMaster ..... 411/350
4,442,571 A * 4/1984 Davis et al. ..... 411/552
4,618,180 A * 10/1986 Muscat ..... 296/120.1
5,275,029 A * 1/1994 Myers ..... 70/128
5,775,748 A * 7/1998 Kurachi ..... 292/341.15
7,152,892 B2 * 12/2006 Rechberg ..... 292/304

FOREIGN PATENT DOCUMENTS

GB 2278873 * 12/1994
JP 08-021147 1/1996
JP 11-172999 6/1999
JP 11-324475 11/1999

* cited by examiner

*Primary Examiner*—Brian E. Glessner
*Assistant Examiner*—Carlos Lugo
(74) *Attorney, Agent, or Firm*—Manabu Kanesaka

(57) ABSTRACT

A locking device for locking an opening-and-closing moving body in a stopped position includes a striker body disposed on one of a striking part of the opening-and-closing moving body and a struck part of a non-moving body hitting against the striking part of the moving body in the stopped position, and a catcher body disposed on the other of the striking part of the moving body and the struck part of the non-moving body. The catcher body includes an inner part with a receiving part for receiving the striker body, an outer part for holding the inner part, a forcing device for urging the inner part, and a damping device for damping the inner part. The forcing device urges the inner part to engage the outer part and stop when the inner part is situated in a forward position.

7 Claims, 13 Drawing Sheets

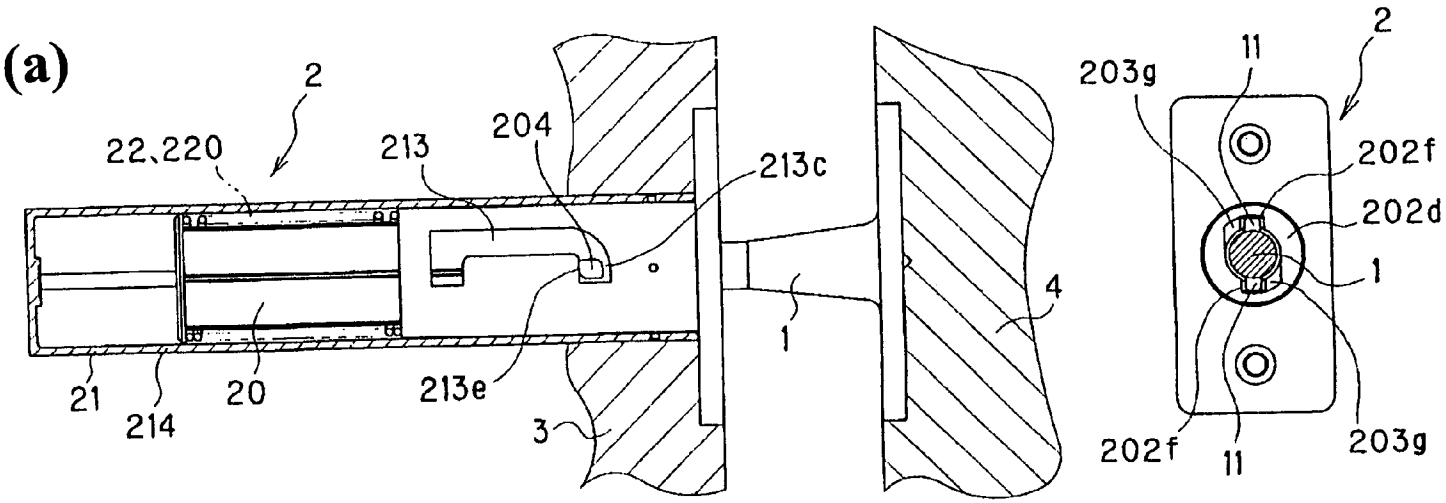
Fig. 4(a)
Fig. 4(c)
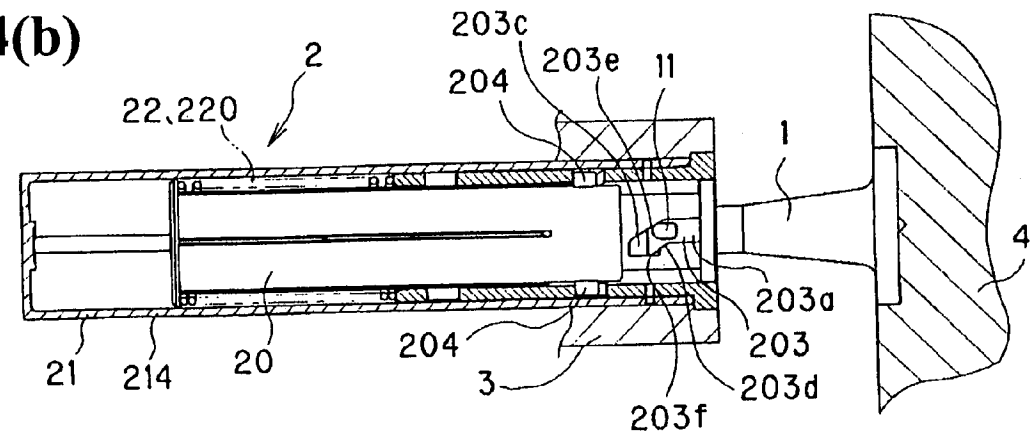
Fig. 4(b)

LOCKING DEVICE

BACKGROUND OF THE INVENTION AND RELATED ART STATEMENT

The invention relates to a locking device for locking an opening-and-closing moving body such as a sliding door or a drawer in a stopped position such as a completely closed position so as to stably maintain a stopped state.

Patent Document 1 has disclosed a shock-absorbing device for absorbing an impact when a sliding door is closed by inserting a dovetail-shaped part provided on a slider into a dovetail-shaped part provided on a receiving member while the sliding door is moving to a stopped position.

With such a shock-absorbing device, it is difficult to completely absorb an impact when the sliding door moves toward the closed direction at an excessive speed. Also, when the speed of movement is too small, the sliding door would stop before completely closed.

Patent Document 1: Japanese Patent Publication (Kokai) No. 08-21147

The problem that the invention attempts to solve resides in that the stopped state of an opening-and-closing moving body can be produced properly, and it can be maintained stably, regardless of the speed of movement of the opening-and-closing moving body toward the stopped position, and in addition, that the stopping can be accomplished gently.

Further objects and advantages of the invention will be apparent from the following description of the invention.

SUMMARY OF THE INVENTION

In order to solve said problem, in this invention, a locking device for locking opening-and-closing moving body in stopped position includes the following features (1) to (5).

(1) The locking device includes a striker body which is provided on either a striking part of an opening-and-closing moving body which is struck against a struck part of a non-moving body in a stopped position or a struck part of the non-moving body, and a catcher body which is provided on the other of these;

(2) the catcher body includes an inner part which has a receiving part for the striker body, an outer part which holds the inner part to be capable of moving forward and backward and rotating around a longitudinal axis of the inner part, a forcing device which normally forces the inner part in the backward direction of drawing into the outer part, and a damping device which applies damping to the movement of the inner part in the backward direction by the forcing device;

(3) in the forward position of the inner part, by the forcing of the forcing device, a part of the inner part is caught on the outer part, and the backward movement of the inner part by the forcing is checked;

(4) the inner part is rotated by the striker body which enters the receiving part of the inner part in the forward position accompanying the movement of the opening-and-closing moving body toward the stopped position, and (5) the striker body is locked in the receiving part by the rotation, and the checking of the backward movement of the inner part is released.

When the opening-and-closing moving body is moved toward the stopped position, the striker body enters the receiving part of the inner part of the catcher body. Accordingly, the inner part in the forward position is rotated. By this rotation, the striker body couples with the inner part. In addition, a backward movement of the inner part is allowed.

Accordingly, the inner part in the forward position is moved in the backward direction by the forcing of the forcing device, and by the backward movement of the inner part, the striker body also is drawn into the depth of the catcher body. Accordingly, a state in which the striking part of the opening-and-closing moving body and the struck part of the non-moving body are mutually striking is produced compulsorily, and the state can be maintained stably. Even if the speed of the movement toward the stopped position of the opening-and-closing moving body is comparatively small, the opening-and-closing moving body can be moved assuredly up to the expected stopped position of the opening-and-closing moving body, in which the striking part and struck part are mutually striking by the coupling between the striker body and the inner part. In such a locking device, because it has the damping device which applies damping to the backward movement of the inner part by the forcing device, even if the speed of the movement of the opening-and-closing moving body toward the stopped position is comparatively large, this can be attenuated, and the striking part and struck part strike firmly without an impact noise.

In order to solve the problems, in the invention, a locking device for locking an opening-and-closing moving body in a stopped position includes the following features (1)–(8).

(1) The locking device includes a striker body which is provided on either a striking part of an opening-and-closing moving body which is struck against a struck part of a non-moving body in a stopped position or a struck part of the non-moving body, and a catcher body which is provided on the other of these;

(2) the striker body includes a shaft part which extends along the direction of movement of the opening-and-closing moving body, and a locking projection which projects out sideways from the side of the shaft part;

(3) the catcher body includes an inner part which has a receiving part for the striker body, an outer part which holds the inner part to be capable of moving forward and backward and rotating around a longitudinal axis of the inner part, a forcing device which normally forces the inner part in the backward direction of drawing into the outer part, and a damping device which applies damping to the movement of the inner part in the backward direction by the forcing device;

(4) in the receiving part of the inner part, there is formed a catch groove which is formed of an entrance groove part which follows the receiving direction of the striker body, and a deep side groove part which is connected to the deep end of the entrance groove part and extends toward a direction intersecting the receiving direction while making a corner in the place of connection;

(5) in either of the inner part or the outer part, there is formed a lock groove which is formed of a straight groove part which follows the direction of movement of the inner part, and a front side groove part which is connected to the front end of the straight groove part and extends toward a direction intersecting the direction of movement while making a corner in the place of connection, and a lock projection which enters the lock groove is formed in the other of these;

(6) in the forward position of the inner part, the lock projection is caught in the front end groove part of the lock groove by the forcing of the forcing device;

(7) the locking projection of the striker body which enters the receiving part of the inner part in the forward position accompanying the movement of the opening-and-closing moving body toward the stopped position is pushed against the outer corner part of the corner of the catch groove and the inner part is rotated forward; and (8) the locking projection is caught in the deep side groove part of the catch groove by the forward rotation, and the lock projection in the front side groove part of the lock groove enters the straight groove part.

When the opening-and-closing moving body is moved toward the stopped position, the striker body enters the receiving part of the inner part of the catcher body, and the locking projection of the striker body enters the catch groove. The locking projection of the striker body in the catch groove is pushed against the outer corner part of the corner of the catch groove, thereby rotating the inner part forward in the forward position. By this forward rotation, the locking projection of the striker body enters the deep side groove part of the catch groove, thereby engaging the striker body with the inner part. In addition, by this forward rotation, the lock projection of the inner part is removed from the front side groove part of the lock groove, and enters the straight groove part. Because the inner part in the forward position is normally forced in the backward direction by the forcing of the forcing device, the inner part is moved backward by the entering of the lock projection the straight groove part. By the backward movement of the inner part, the striker body also is drawn into the depth of the catcher body. Accordingly, a state in which the mutual striking between the striking part of the opening-and-closing moving body and the struck part of the non-moving body is produced compulsorily, and the state can be maintained stably. Even if the speed of the movement toward the stopped position of the opening-and-closing moving body is comparatively small, the opening-and-closing moving body can be moved assuredly up to the expected stopped position of the opening-and-closing moving body, in which the striking part and struck part are mutually striking by the coupling between the striker body and the inner part. In such s locking device, because it has a damping device which applies damping to the backward movement of the inner part by the forcing device, even if the speed of the movement toward the stopped position of the opening-and-closing moving body is comparatively large, this can be attenuated, and the striking part and struck part strike firmly without an impact noise.

Accompanying the movement of the inner part toward the forward position by operation of the opening-and-closing moving body to be moved toward the original position, in the stopped position with the locking projection of the striker body being caught in the deep side groove part of the catch groove of the inner part in the backward position, the lock projection is pushed against the outer corner part of the corner of the lock groove and the inner part is rotated in reverse. The locking projection is removed from the deep side groove part of the catch groove by this reverse rotation.

By moving the opening-and-closing moving body in the stopped position toward the original position, the lock projection of the inner part again enters the front side groove part of the lock groove whereby the inner part is restored to the forward position, and the state can be maintained. In addition, the coupling between the inner part and striker body is released whereby the striker can be removed from the receiving part of the inner part, and the state of maintaining the stopped position of the opening-and-closing moving body by the locking device can be released smoothly with one action.

On the side of the entrance of the entrance groove part of the catch groove on the receiving part of the inner part, there is formed a cam surface which is struck by the locking projection by striking the striker body on the inner part rotated forward and moved to the backward position by erroneous operation, and causes the inner part to rotate in reverse, so that the locking projection enters the catch groove.

If the opening-and-closing moving body is moved toward the stopped position from a state in which the inner part is erroneously moved backward, the locking projection of the striker body is struck on the cam surface, and the inner part is rotated in reverse. Accordingly, it is possible to make the locking projection of the striker body enter the catch groove. When the locking projection of the striker body enters the catch groove, the locking projection is pushed against the outer corner part of the corner of the catch groove, the inner part is rotated forward, the locking projection is caught in the deep side groove part of the catch groove, and a state being the same as when the striker body is received by the catcher body is produced correctly.

The locking projections are formed respectively on both the left and right sides of the striker body. In addition, catch grooves, lock grooves, and lock projections are formed respectively on one side and the other side of an imaginary plane including the central axial line of the inner part following the longitudinal direction of this inner part.

Accordingly, the inner part can be rotated forward smoothly accompanying the movement toward the stopped position of the opening-and-closing moving body. By moving the opening-and-closing moving body toward the original position from the stopped position of the opening-and-closing moving body having the striker body coupled with the inner part by this forward rotation, a state in which the inner part is restored to the forward position while smoothly rotating the inner part in reverse to release such coupling can be maintained.

The damping device comprises a cylinder which is provided on either of the inner part or the outer part, a head part which has an orifice which divides the space inside this cylinder into two parts, and a shaft part which is provided on the other of the inner part or the outer part and supports the head part having been inserted inside this cylinder. The damping force is generated by fluid resistance of a fluid passing through the orifice by backward movement of the inner part.

When the inner part in the forward position is moved backward by the force of the forcing device, accompanying this, the head part inside the cylinder is moved or relatively moved while the fluid is passed through the orifice provided on this head part. Accordingly, the damping can be applied properly to the movement of the inner part.

A flow channel of the fluid reaching the orifice is made narrower as the pushing-in speed of the inner part becomes greater.

As the speed of movement or relative movement of the head part, that is, the speed of backward movement of the inner part constituting the locking device, that is, the speed of movement of the opening-and-closing moving body toward the stopped position, becomes greater, the damping force on the backward movement can be made greater. The striking part and struck part are mutually striking in a manner such that an impact noise is not made regardless of the speed of the movement toward the stopped position of the opening-and-closing moving body.

In the locking device of the invention, the stopped state of an opening-and-closing moving body can be produced properly, and it can be maintained stably, regardless of the speed of the movement of the opening-and-closing moving body toward that stopped position. Also, the stopping can be accomplished gently.

BRIEF DESCRIPTION OF THE DRAWINGS

FIG. 4(*a*) is a sectional side view of the essential components of the locking device, FIG. 4(*b*) is a sectional plan view of the essential components, and FIG. 4(*c*) is a front view of the catcher body (2) (a striker body (1) is shown in section taken along line 4(*c*)—4(*c*) in FIG. 2. Same below up to FIG. 13(*c*))

DETAILED DESCRIPTION OF PREFERRED EMBODIMENTS

Hereunder, preferred embodiments for implementing the invention will be explained with reference to FIG. 1 through FIG. 13(*a*)–13(*c*).

Figure 1:
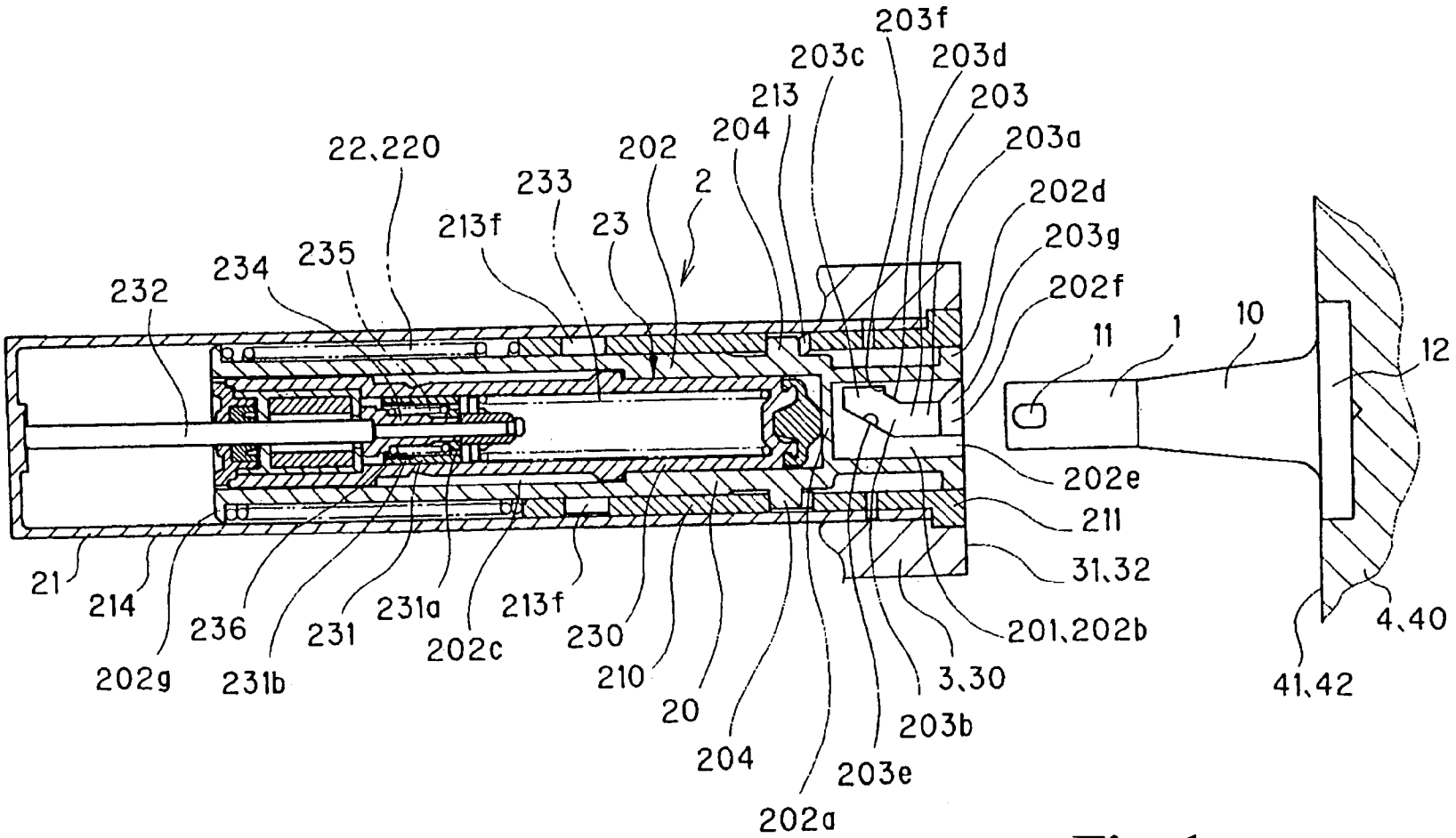
FIG. 1 is a sectional plan view of essential components of a locking device.
Figure 2:
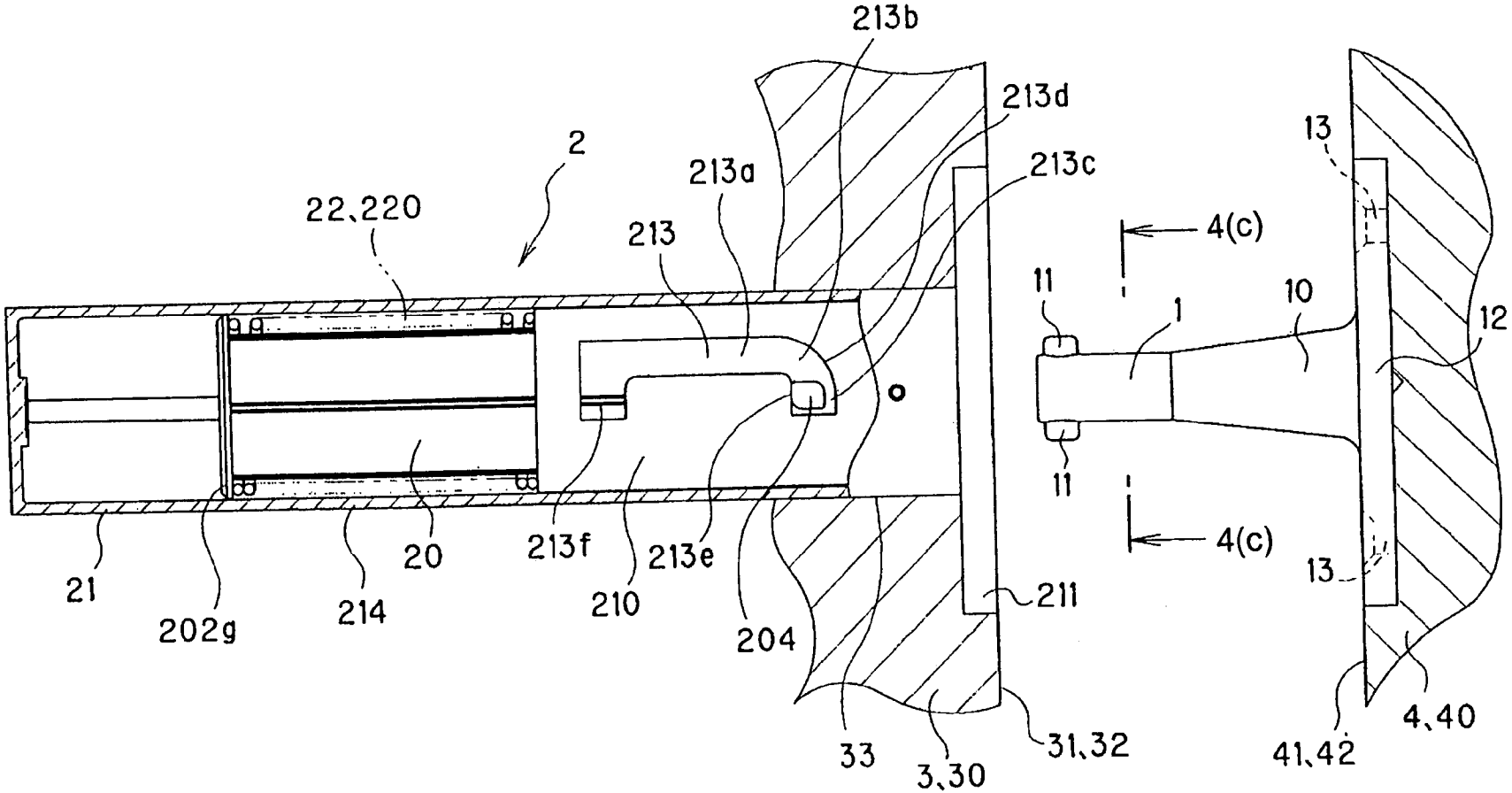
FIG. 2 is a sectional side view of the essential components of the same.
Figure 3:
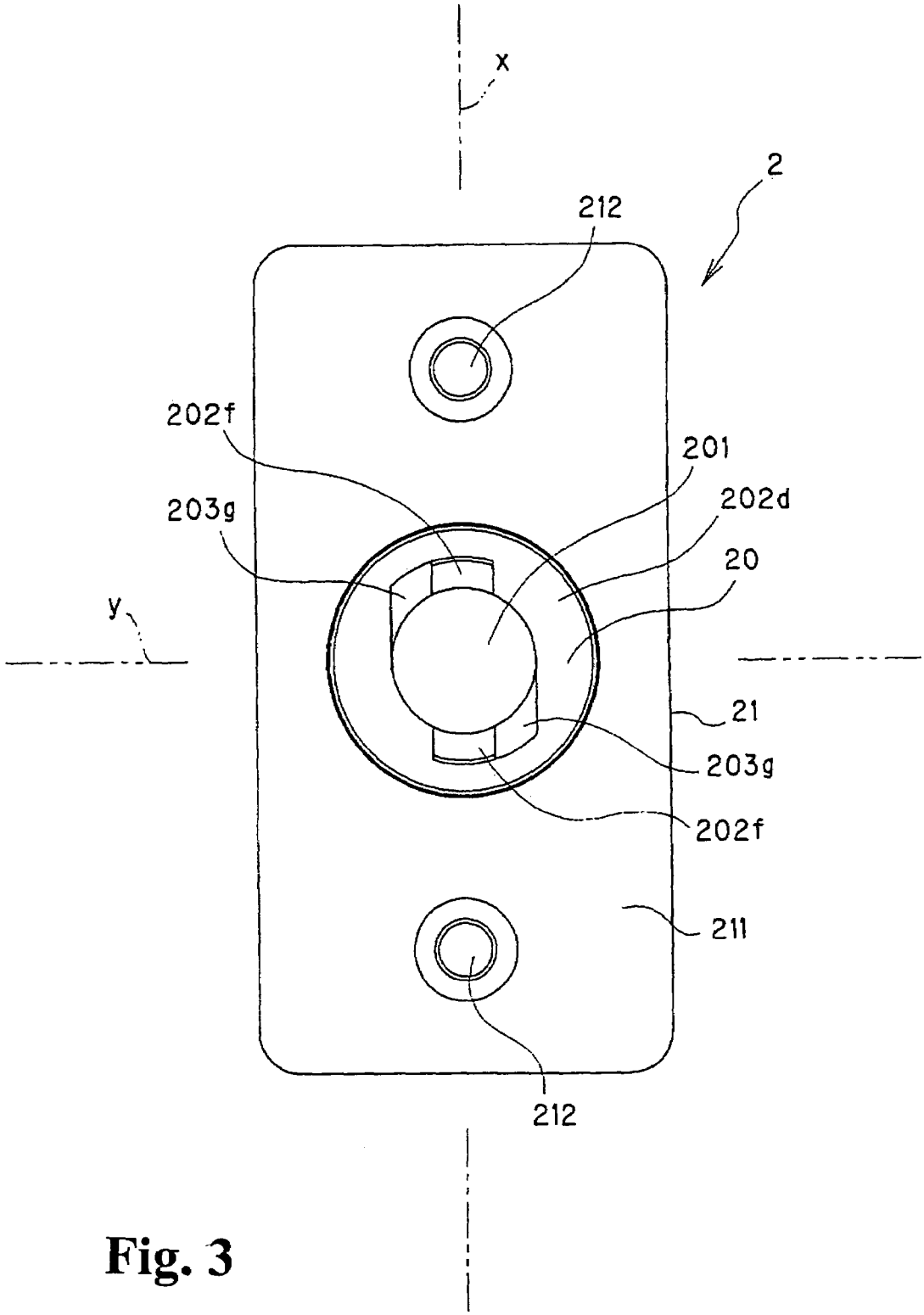
FIG. 3 is a front view of a catcher body (2)
Figure 5C:
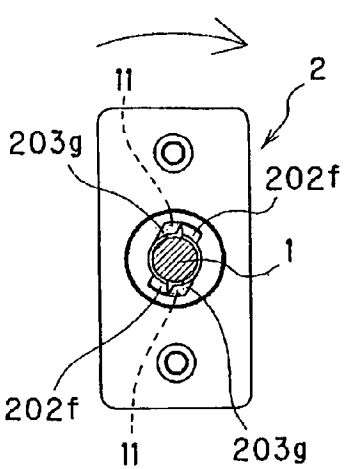
FIG. 5(*a*) is a sectional side view of the essential components of the locking device, FIG. 5(*b*) is a sectional plan view of the essential components, and FIG. 5(*c*) is a front view of the catcher body (2)
Figure 5A:
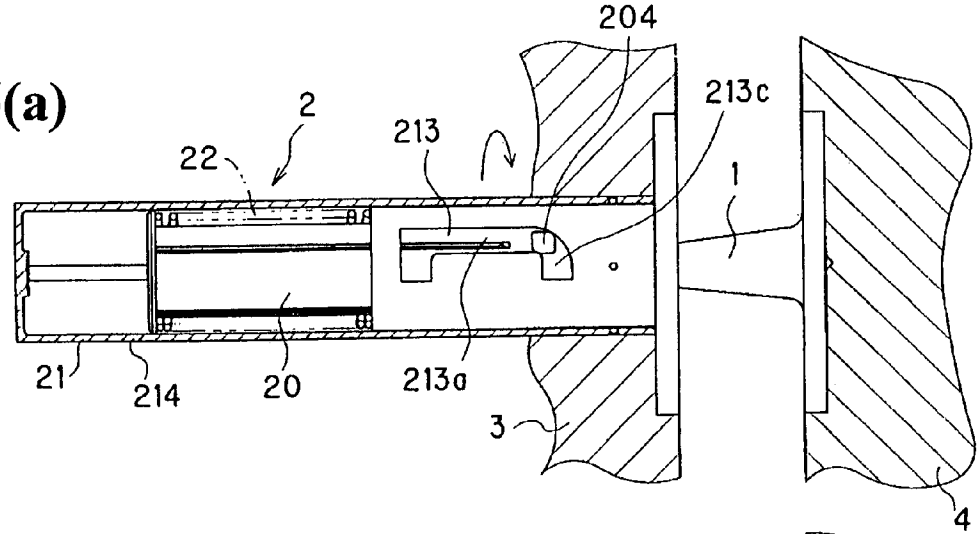
Figure 5B:
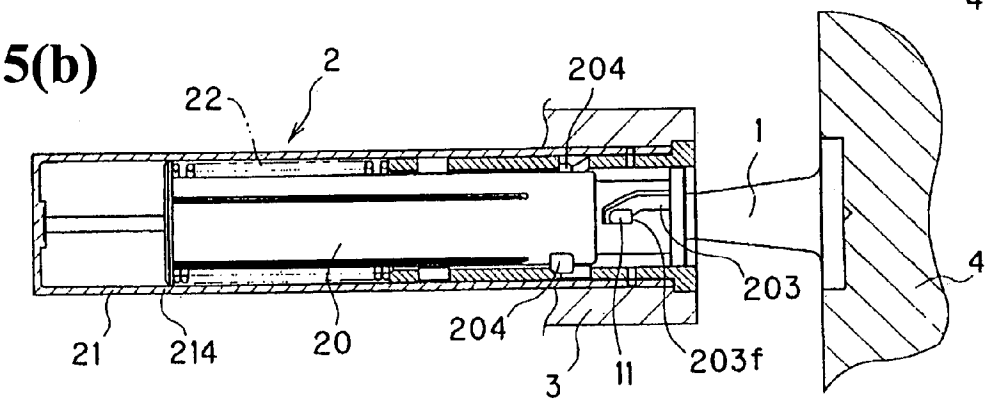
Figure 6C:
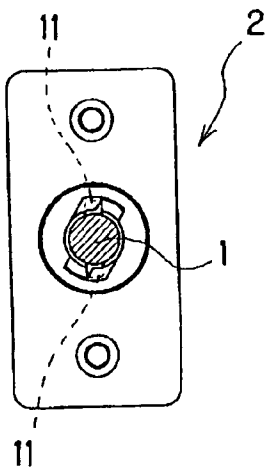
FIG. 6(*a*) is a sectional side view of the essential components of the locking device, FIG. 6(*b*) is a sectional plan view of the essential components, and FIG. 6(*c*) is a front view of the catcher body (2)
Figure 6A:
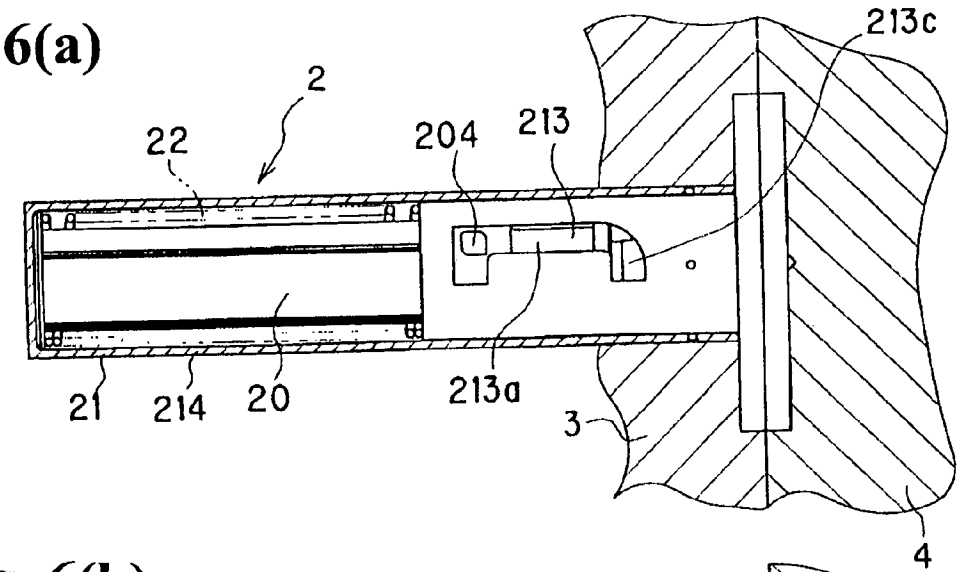
Figure 6B:
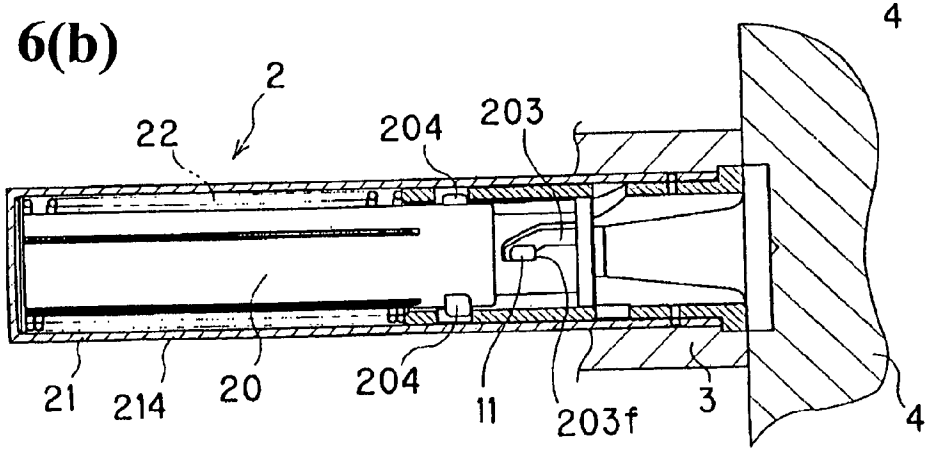

FIG. 1 shows a striker body 1 and a catcher body 2 constituting a locking device in a disassembled state viewed from above, and FIG. 2 shows the striker body 1 and the catcher body 2 viewed from a side. FIG. 3 shows the catcher body 2 viewed from a right side in FIG. 2.

Figure 13C:
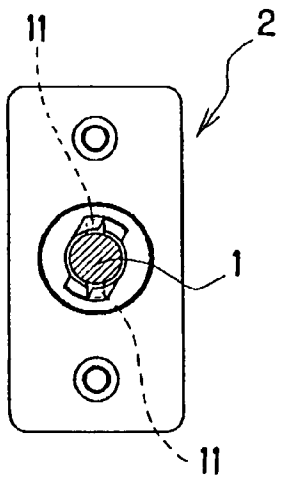
FIG. 13(*a*) is a sectional side view of the essential components of the locking device, FIG. 13(*b*) is a sectional plan view of the essential components, and FIG. 13(*c*) is a front view of the catcher body (2).
Figure 13A:
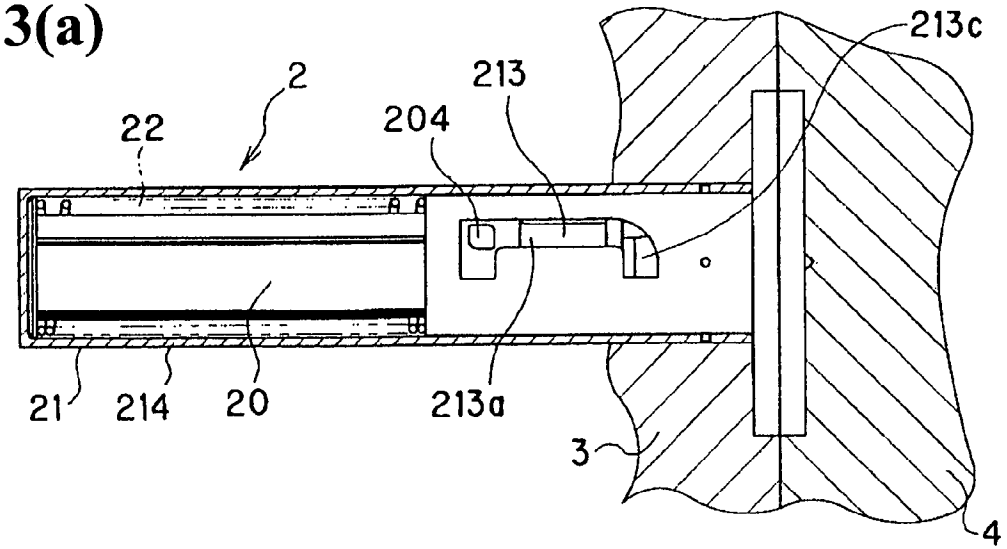
Figure 13B:
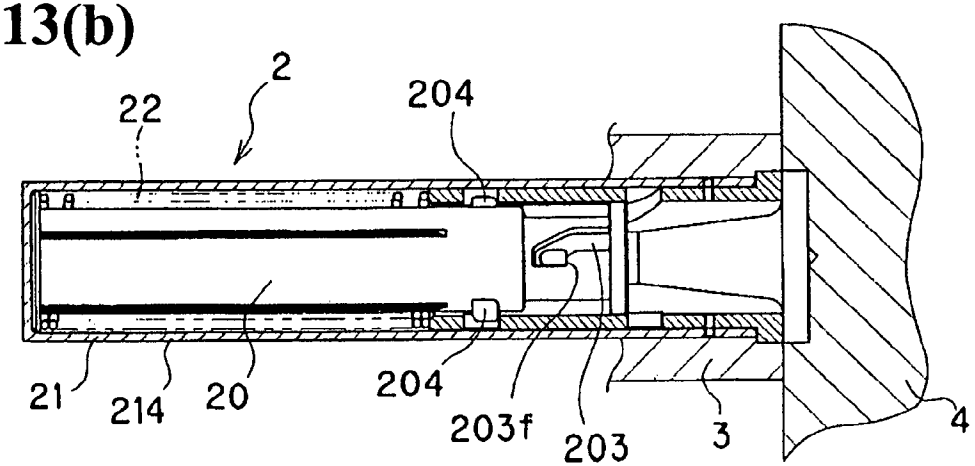

FIG. 4(*a*)–4(*c*) through FIG. 13(*a*)–13(*c*) show each operation of the locking device for each stage so as to make the operation easier to understand. When an opening-and-closing moving body 3 is moved toward a stopped position (moved forward), the striker body 1 and the catcher body 2 are locked in the order of FIGS. 4(*a*)–4(*c*), FIGS. 5(*a*)–5(*c*) and FIGS. 6(*a*)–6(*c*), and the opening-and-closing moving body 3 is positioned at the stopped position (position in FIGS. 6(*a*)–6(*c*)) by this locking. When the opening-and-closing moving body 3 in the stopped position is moved toward the original position (moved back), the locking between the striker body 1 and the catcher body 2 is released in the order of FIGS. 7(*a*)–7(*c*), FIGS. 8(*a*)–8(*c*), and FIGS. 9(*a*)–9(*c*). In the case that an inner part 20 of the catcher body 2 is moved backward by an erroneous operation while in a state in which the striker body 1 is not inserted into the catcher body 2, when the opening-and-closing moving body 3 is moved toward the stopped position so as to cause the striker body 1 to be inserted into the catcher body 2, the striker body 1 and the catcher body 2 are locked in the order of FIGS. 10(*a*)–10(*c*), FIGS. 11(*a*)–11(*c*), FIGS. 12(*a*)–12(*c*), and FIGS. 13(*a*)–13(*c*), and the opening-and-closing moving body 3 is positioned at the stopped position by this locking.

The locking device pertaining to the embodiment is for locking the opening-and-closing moving body 3 such as a sliding door 30 or drawer in the stopped position so as to stably maintain this stopped state.

For example, in the case that it is used in a sliding door 30, the state in which the sliding door 30 closes an open part is maintained by the locking device.

Also, in the case that it is used in a drawer, the state in which the drawer is housed and the open part of the drawer housing body is closed by the front plate part of the drawer is maintained by the locking device.

The locking device has the striker body 1 and the catcher body 2.

The striker body 1 is provided on either a striking part 31 of the opening-and-closing moving body 3 (for example, an end part 32 positioned at a front of movement of the sliding door 30 when it is moved to be closed in) which is struck against a struck part 42 of a non-moving body 4 (for example, an inner surface part 41 of an open part of a building, or the like, which is closed to be capable of opening by the sliding door 30) in a stopped position, or is provided on the struck part 42 of the non-moving body 2, and the catcher body 2 is provided on the other of these.

(Striker Body 1)

The striker body 1 has a shaft part 10 which extends following the direction of movement of the opening-and-closing moving body 3, and a locking projection 11 which projects out sideways from the side of the shaft part 10.

In the illustrated example, the striker body 1 is one surface of a roughly rectangular plate-shaped attachment plate 12, and it is constituted such that one end of a bar-shaped shaft part 10 is integrally connected in a position at about the middle in a longitudinal direction. The shaft part 10 projects out in a direction orthogonal to one surface of the attachment plate 12. In such attachment plate 12, insertion holes 13 for screws, or the like, are formed respectively on both sides surrounding the shaft part 10. In the illustrated example, the striker body 1 is provided on a sliding door frame 40, that is, the non-moving body 4, by fixing the other side of the attachment plate 12 to the sliding door frame 40 which constitutes the inner surface part of the open part which is closed by the sliding door 30 using screws, or the like, inserted into the insertion holes 13. In the illustrated example, the striker body 1 is attached to the sliding door frame 40 in a manner such that the shaft part 10 projects out toward the lateral direction from the sliding door frame 40 which follows the vertical direction. Also, in the illustrated example, the shaft part 10 of such striker body 1 is constituted roughly as a circle in section in the direction orthogonal to its axial line. Also, in the illustrated example, locking projections 11 are provided respectively in positions on both sides in the diameter direction of the other end part of such shaft part 10. The locking projections 11 in the two places are constituted so as to have the same dimensions and same shape, and in addition, one projects out upwardly and the other one projects out downwardly.

(Catcher Body 2)

The catcher body 2 has an inner part 20 which has a receiving part 201 for the striker body 1, an outer part 21 which holds the inner part 20 to be capable of moving forward and backward and to be capable of rotating centered on the longitudinal axis of the inner part 20, a forcing device 22 which normally forces the inner part 20 in the backward direction of drawing into the outer part 21, and a damping device 23 which applies damping to the movement in the backward direction (movement toward the left side in FIGS. 4(*a*)–4(*c*)) of the inner part 20 by the forcing device 22.

In the illustrated example, the inner part 20 is held, and in addition, the forcing device 22 and the damping device 23 are held inside the outer part 21 which has a cylindrical shape in which one cylinder end is open and the other cylinder end is closed. Also, in the illustrated example, the catcher body 2 is provided on the sliding door 30, that is, the opening-and-closing moving body 3, by first inserting the other end side of the inner part 20 into the attachment hole 33 which is open in the end part 32 positioned on the front side of movement when the sliding door 30 is moved to be closed and continues inside the sliding door 30 in a direction following the direction of movement of the sliding door 30. In the illustrated example, the one cylinder end of the inner part 20 thus inserted is positioned about on the same surface as the surface of the end part 32 of the sliding door 30.

(Catcher Body 2/Inner Part 20)

In the illustrated example, the inner part 20 has a main body part 202 which has a cylindrical shape in which both cylinder ends are open. The main body part 202 is divided by a dividing wall 202*a* into two parts, being a forward chamber 202*b* which is narrow in depth, and a rear chamber 202*c* which is wide in depth. Also, the forward chamber 202*b* serves as the receiving part 201.

In the receiving part 201 of the inner part 20, there is formed a catch groove 203 which is formed of an entrance groove part 203*a* which follows the receiving direction of the striker body 1, and a deep side groove part 203*c* which is connected to the deep end of the entrance groove part 203*a* and extends toward a direction intersecting the receiving direction while making a corner 203*b* in the place of connection.

In the illustrated example, a circular flange 202*d* which projects outwardly is formed on the front cylinder end of the main body part 202. In the circular flange 202*d*, introduction cavities 202*f* for the locking projections 11 of the striker body 1, which are connected to the cylinder front end opening 202*e* and extend to the side, are formed respectively on both sides in the diameter direction of the cylinder front end opening 202*e* of this main body part 202, and the introduction cavity 202*f* serves as an entrance of the entrance groove part 203*a* of the catch groove 203.

The catch groove 203 is constituted as a notch shape which passes through the side wall of the forward chamber 202*b* of the main body part 202. Also, the entrance groove part 203*a* continues straight following the cylinder axis of the forward chamber 202*b* up to a position at about the middle in the longitudinal direction of this forward chamber 202*b*. An inner corner part 203*d* and an outer corner part 203*e* are formed in the place of connection between the deep side groove part 203*c* and the entrance groove part 203*a*. In the illustrated example, the outer corner part 203*e* has a slope about 30 degrees relative to the cylinder axial line of the forward chamber 202*b*. The inner corner part 203*d* is roughly parallel to the outer corner part 203*e*, and is shorter than the outer corner part 203*e*. A part ahead of the inner corner part 203*d* of the deep side groove part 203*c* extends in a direction roughly orthogonal to the cylinder axial line of the forward chamber 202*b*. In the deepest part of the deep side groove part 203*c*, there is formed a catching surface 203*f* for the locking projection 11 of the striker body 1, which is oriented toward the rear.

In the illustrated example, the catch grooves 203 are formed respectively on one side and the other side of a second imaginary plane y including the central axial line of the inner part 20, that is, the cylinder axial line of the inner part 20 following the longitudinal direction of the inner part 20. A pair of catch grooves 203 is formed such that when viewing the inner part 20 in the direction of viewing one catch groove 203 from the front, the other catch groove 203 positioned on the back side is vertically inverted to the catch groove 203 on the one side.

On the outside of the rear chamber 202*c* in the inner part 20 in the vicinity of the position of formation of the dividing wall 202*a*, there is formed a lock projection 204 which enters a lock groove 213 (described later). In the illustrated example, the lock projections 204 are formed respectively on both sides in the diameter direction of the inner part 20. A line part joining the positions of formation of the pair of catch grooves 203 has about a 90 degree angle to a line part joining the positions of formation of the pair of lock projections 204.

A circular flange 202*g* which projects outwardly is formed also on the rear cylinder end of the main body part 202 of the inner part 20.

(Catcher Body 2/Outer Part 21)

In the illustrated example, the outer part 21 is constituted by combining an inner cylinder body 210 which has an inner diameter about equal to the outer diameter of the inner part 20 and both cylinder ends open, and an outer cylinder body 214 which has an inner diameter about equal to the outer diameter of the inner cylinder body 210 and the cylinder front end (right side in FIGS. 4(*a*)–4(*c*)) open and the cylinder rear end (left side in FIGS. 4(*a*)–4(*c*)) closed. The cylinder front end (right side in FIGS. 4(*a*)–4(*c*)) of the inner cylinder body 210 is connected in a position at about the middle in the length direction of the roughly rectangular plate-shaped attachment plate 211. The attachment plate 211 is pierced through by the open cylinder front end of the inner cylinder body 210. In such attachment plate 211, insertion holes 212 for screws, or the like, are formed respectively on both sides surrounding the position of connection of the inner cylinder body 210. In the illustrated example, the catcher body 2 is provided on the sliding door 30 by fixing the attachment plate 211 to the surface of the end part 32 of the sliding door 30 using a screw, or the like, inserted into the insertion holes 212.

In the illustrated example, the total length of the inner cylinder body 210 is constituted to become shorter than the total length of the main body part 202 of the inner, part 20 and the outer cylinder body 214. Furthermore, the total length of the main body part 202 of the inner part 20 is constituted to become shorter than the total length of the outer cylinder body 214. In the illustrated example, the inner cylinder body 210, the outer cylinder body 214, and the main body part 202 of the inner part 20 are assembled together by inserting the inner cylinder body 210 with the cylinder rear end side of the inner cylinder body 210 first into the outer cylinder body 214 from the cylinder front end of the outer cylinder body 214, up to a position where the cylinder front end of the outer cylinder body 214 is butted against the back surface of the attachment plate of the inner cylinder body 210, and in addition, by winding a compression coil spring 220 on the outside of the main body part 202 of the inner part 20 in a manner such that the front end of the spring is pushed against the cylinder rear end of the inner cylinder body 210 thus inserted, and the rear end of the spring is pushed against the circular flange 202*g* formed on the cylinder rear end of the main body part 202 of the inner part 20. In the illustrated example, the spring 220 functions as the forcing device 22.

In this embodiment, in the outer part 21, there is formed a lock groove 213 which is formed of a straight groove part 213*a* which follows the direction of movement of the inner part 20, and a front side groove part 213*c* which is connected to the front end of the straight groove part 213*a* and extends toward a direction intersecting the direction of movement while making a corner 213*b* in the place of connection. In addition, a lock projection 204 which enters the lock groove 213 is formed on the inner part 20.

In the illustrated example, the straight groove part 213*a* of the lock groove 213 is formed so as to extend following the cylinder axis of the outer part 21. The front side groove part 213*c* extends in a direction roughly orthogonal to the cylinder axis of this outer part 21. In the illustrated example, an outer corner part 213*d* of the corner formed in the place of connection between such straight groove part 213*a* and front side groove part 213*c* is formed in an R-shape. A catching surface 213*e* of the lock projection 204, which is provided on the front side, is formed by this front side groove part 213*c*. In the illustrated example, the lock groove 213 has a rear side groove part 213*f* which is connected to the rear end of the straight groove part 213*a* and extends in a direction roughly orthogonal to the cylinder axis of the outer part 21. The rear side groove part 213*f* extends in the same direction as the front side groove part 213*c*, so that the lock groove 213 presents a roughly square bracket shape viewed from the side.

In the illustrated example, the lock grooves 213 are formed respectively on one side and the other side of an imaginary plane surrounding the longitudinal axis of the inner part 20, that is, a first imaginary plane x surrounding the cylinder axial line of the outer part 21. A pair of lock grooves 213 is formed such that when viewing the inner part 20 in the direction of viewing one lock groove 213 from the front, the other lock groove 213 positioned on the back side is vertically inverted to the lock groove 213 on the one side.

In this embodiment, in the forward position of the inner part 20, the lock projection 204 is caught on the catching surface 213*e* of the front side groove part 213*c* of the lock groove 213 by the forcing of the forcing device 22, whereby the forward state is maintained.

The locking projection 11 of the striker body 1 which enters the receiving part 201 of the inner part 20 in the forward position accompanying the movement of the opening-and-closing moving body 3 toward the stopped position is pushed against the outer corner part 203*e* of the corner of the catch groove 203 and the inner part 20 is rotated forward. The locking projection 11 is caught on the catching surface 203*f* of the deep side groove part 203*c* of the catch groove 203 by the forward rotation. The lock projection 204 which is in the front side groove part 213*c* of the lock groove 213 part enters the straight groove part 213*a*.

(Function)

When the opening-and-closing moving body 3 is moved toward the stopped position, the striker body 1 enters the receiving part 201 of the inner part 20 of the catcher body 2, and the locking projection 11 of the striker body 1 enters the catch groove 203 (FIGS. 4(*a*)–4(*c*)). The locking projection 11 of the striker body 1 in the catch groove 203 is pushed against the outer corner part 203*e* of the corner of this catch groove 203, and by this, the inner part 20 in the forward position is rotated forward (FIGS. 4(*a*)–4(*c*) to FIGS. 5(*a*)–5(*c*)). By this forward rotation, the locking projection 11 of the striker body 1 enters the deep side groove part 203*c* of the catch groove 203, and by this, the striker body 1 is coupled with the inner part 20 (FIGS. 5(*a*)–5(*c*)). In addition, by this forward rotation, the lock projection 204 of the inner part 20 is removed from the front side groove part 213*c* of the lock groove 213 part and enters the straight groove part 213*a*. Because the inner part 20 in the forward position is normally forced in the backward direction by the forcing of the forcing device 22, the inner part 20 is moved backward by the entering of the lock projection 204 inside the straight groove part 213*a*. By the backward movement of the inner part 20, the striker body 1 also is drawn into the depth of the catcher body 2 (FIGS. 6(*a*)–6(*c*)). Accordingly, a state in which the striking part 31 of the opening-and-closing moving body 3 and the struck part 42 of the non-moving body 4 are mutually striking is produced compulsorily, and the state can be maintained stably. Even if the speed of movement toward the stopped position of the opening-and-closing moving body 3 is comparatively small, the opening-and-closing moving body 3 can be moved assuredly up to the expected stopped position of the opening-and-closing moving body 3, in which the striking part 31 and struck part 42 are mutually striking by the coupling between the striker body 1 and the inner part 20.

For example, in the case that the locking device is used in the sliding door 30, a state in which the sliding door 30 closes the open part without a gap can be produced assuredly accompanying the closing operation of the sliding door 30, and the state can be maintained stably.

Because the locking device has the damping device 23 which applies damping to the backward movement of the inner part 20 by the forcing device 22, even if the speed of movement toward the stopped position of the opening-and-closing moving body 3 is comparatively large, this can be attenuated, and the striking part 31 and struck part 42 strike firmly and without an impact noise.

(Damping Device 23)

In the illustrated example, such damping device 23 comprises:

(1) a cylinder 230 which is provided on the inner part 20, (2) a head part 231 which has an orifice 231*a* which divides the space inside the cylinder 230 into two parts, and (3) a shaft part 232 which is provided on the outer part 21 and supports the head part 231 inserted into the cylinder 30; and (4) the damping force is generated by fluid resistance of a fluid passing through the orifice 231*a* by backward movement of the inner part 20.

Concretely, in the illustrated example, the cylinder 230 is built into the rear chamber 202*c* of the main body part 202 of the inner part 20. The rear end of the shaft part 232 is built into the rear end of the outer cylinder body 214 of the outer part 21. A first compression coil spring 233 is interposed between the front end of the shaft part 232 and the front end of the cylinder 230, and when not operating, the head part 231 is positioned to the rear end side of the cylinder 230. The inside of the cylinder 230 typically is filled with a viscous fluid such as silicon oil as said fluid (FIG. 1).

When the inner part 20 in the forward position is moved backward by the forcing of the forcing device 22, accompanying this, the cylinder 230 is moved backward while the fluid is passed through the orifice 231*a* provided on the head part 231. By this, the damping can be applied properly to the movement of this inner part 20.

In this embodiment, the flow channel 236 of the fluid reaching the orifice 231*a* is made narrower as the pushing-in speed of the inner part 20 becomes greater.

Concretely, in the illustrated example, the head part 231 is combined on the shaft part 232 to be capable of moving forward and backward following the axial direction of the shaft part 232, and in addition, a cylindrical part 231*b* is formed to the rear of the head part 231. The head part 231 is normally forced forward by a second compression coil spring 235 which is interposed between a flow channel formation 234 provided on the shaft part 232 and the back surface of this head part 231 so as to be positioned inside the cylindrical part 231*b* of the head part 231. The fluid passes through the flow channel 236 between the outer surface of the flow channel formation 234 and the inner surface of the cylindrical part 231*b*. The flow channel formation 234 is constituted such that the outer diameter is made larger gradually as it goes backward. As the speed of movement of the cylinder 230, that is, the speed of backward movement of the inner part 20 constituting the locking device, that is, the speed of movement of closing of the opening-and-closing moving body 3, becomes greater, the head part 231 is moved backward in opposition to the forcing of the second compression coil spring 235 by the resistance of the fluid accompanying the movement of the cylinder 230, and the flow channel 236 is made narrower.

By this, in this embodiment, as the speed of backward movement of the inner part 20 constituting the locking device, that is, the speed of closing of the opening-and-closing moving body 3, becomes greater, the damping force on the backward movement can be made greater. The striking part 31 and struck part 42 are mutually striking in a manner such that an impact noise is not made regardless of the magnitude of the speed of movement toward the stopped position of the opening-and-closing moving body 3. As the damping device 23, more concretely, that which is described in Japanese Patent Application (Kokai) No. 2003-433572, which was previously disclosed by the present applicants, can be used.

(Other Structure)

In this embodiment, by moving the opening-and-closing moving body 3 from the stopped position of this opening-and-closing moving body 3, in which the locking projection 11 of the striker body 1 is caught in the deep side groove part 203*c* of the catch groove 203 of the inner part 20 in the backward position, toward the original position, that is, by moving the sliding door 30 in the opening direction in the illustrated example, the lock projection 204 is pushed against the outer corner part 213*d* of the corner of the lock groove 213 and the inner part 20 is rotated in reverse accompanying the moving of the inner part 20 toward the forward position. By this reverse rotation, the locking projection 11 is removed from the deep side groove part 203*c* of the catch groove 203.

Figure 7C:
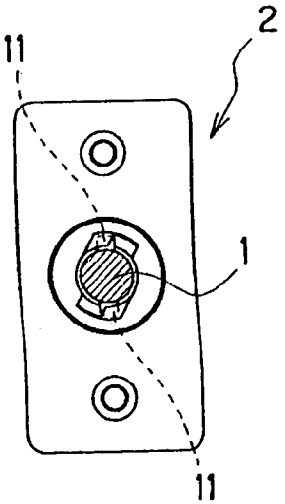
FIG. 7(*a*) is a sectional side view of the essential components of the locking device, FIG. 7(*b*) is a sectional plan view of the essential components, and FIG. 7(*c*) is a front view of the catcher body (2)
Figure 7A:
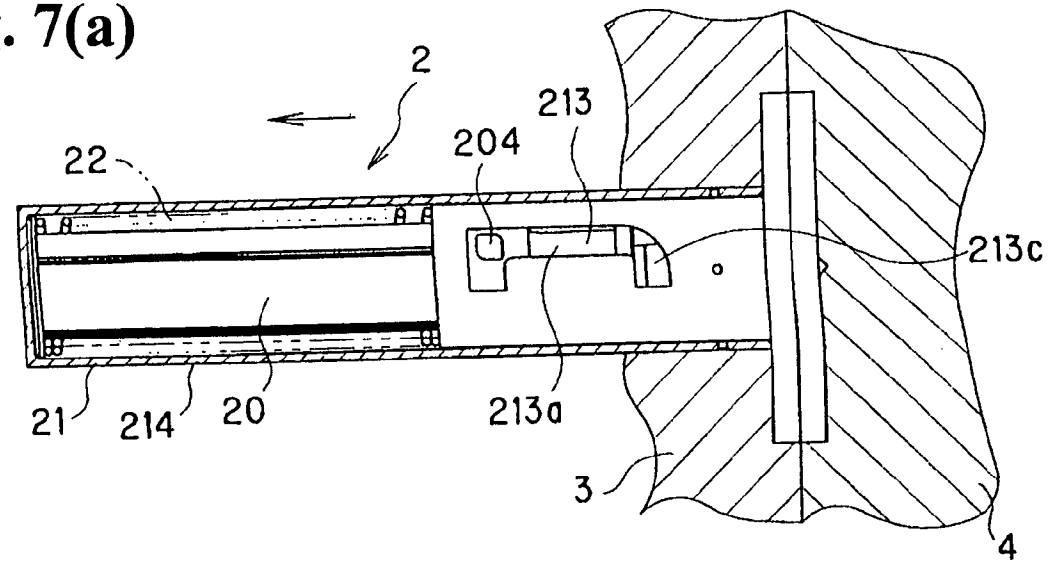
Figure 7B:
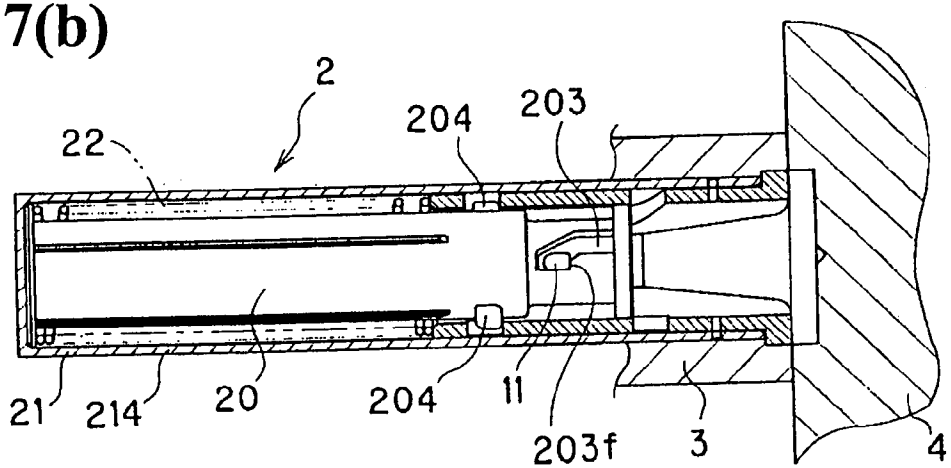
Figure 8C:
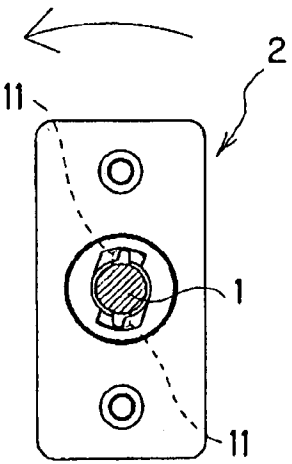
FIG. 8(*a*) is a sectional side view of the essential components of the locking device, FIG. 8(*b*) is a sectional plan view of the essential components, and FIG. 8(*c*) is a front view of the catcher body (2)
Figure 8A:
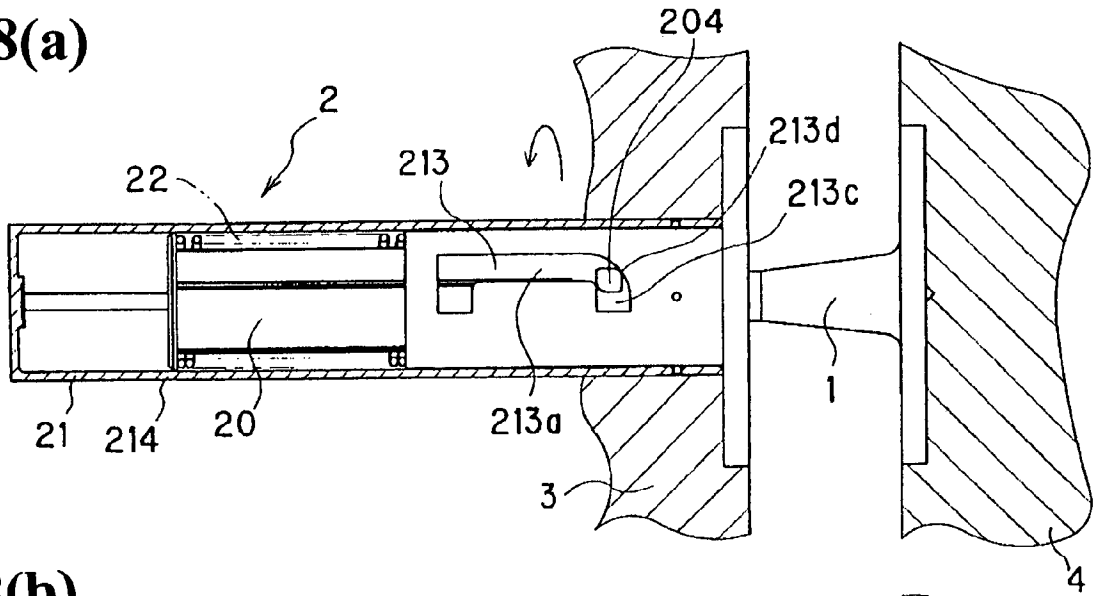
Figure 8B:
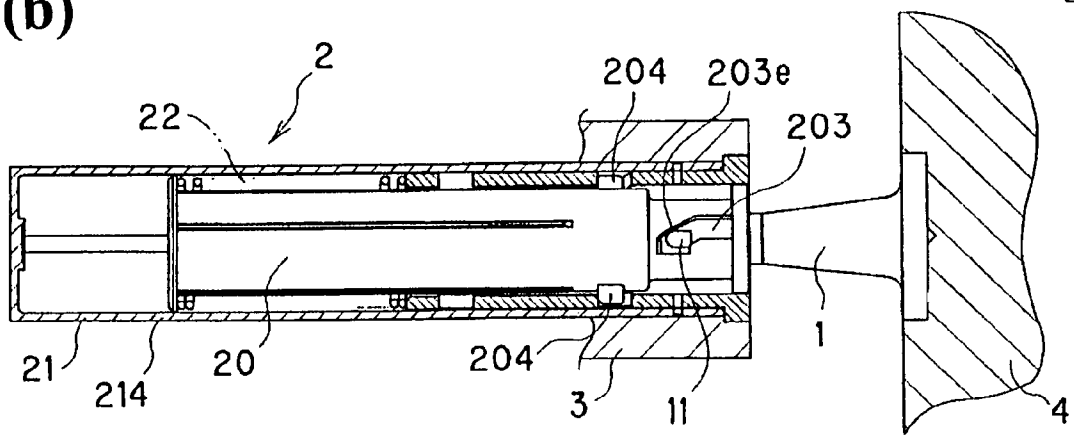
Figure 9C:
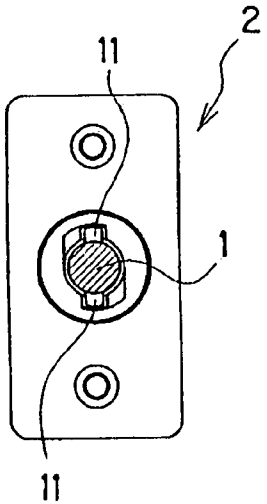
FIG. 9(*a*) is a sectional side view of the essential components of the locking device, FIG. 9(*b*) is a sectional plan view of the essential components, and FIG. 9(*c*) is a front view of the catcher body (2)
Figure 9A:
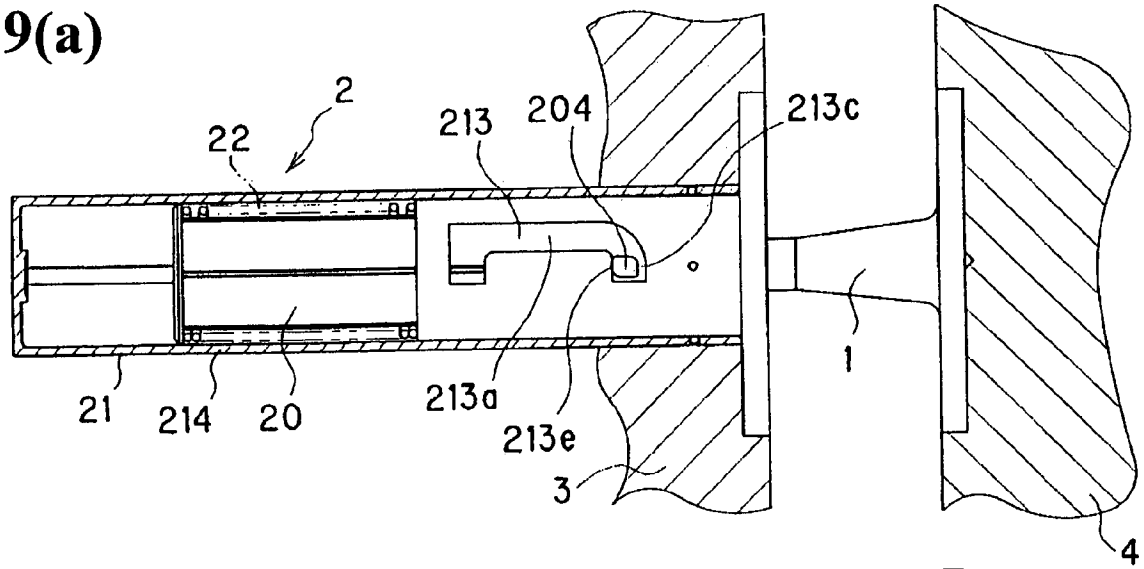
Figure 9B:
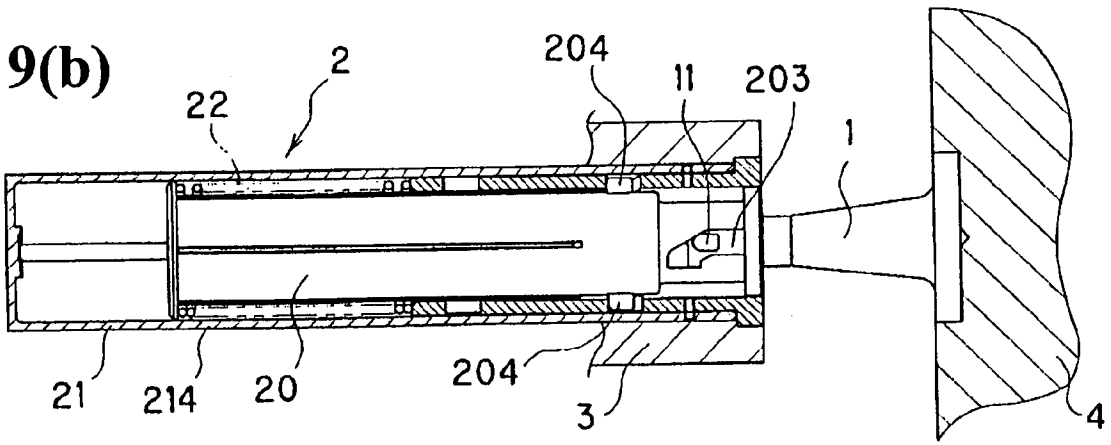

In the illustrated example, when the inner part 20 is moved forward accompanying the movement of the opening-and-closing moving body 3 toward the original position from the stopped position (FIGS. 7(*a*)–7(*c*)), the lock projection 204 of the inner part 20 is moved from the rear end of the lock groove 213 to the front end, and in addition, it is pushed from the rear against the outer corner part 213*d* of the corner of the R-shaped lock groove 213 as previously noted, and by this pushing, the inner part 20 is rotated in reverse (FIGS. 8(*a*)–8(*c*)).

By this, in this embodiment, by moving the opening-and-closing moving body 3 in the stopped position in the opening direction, the lock projection 204 of the inner part 20 again enters the front side groove part 213*c* of the lock groove 213 whereby the inner part 20 is restored to the forward position, and this state can be maintained. In addition, the coupling between the inner part 20 and striker is released whereby the striker body 1 can be removed from the receiving part 201 of the inner part 20. The state of maintaining the stopped position of the opening-and-closing moving body 3 by the locking device can be released smoothly with one action (FIGS. 9(*a*)–9(*c*)).

In this embodiment, on the side of the entrance of the entrance groove part 203*a* of the catch groove 203 on the receiving part 201 of the inner part 20, there is formed a cam surface 203*g* which is struck by the locking projection 11 by striking the striker body 1 on the inner part 20 rotated forward and moved to the backward position by an erroneous operation, and causes the inner part 20 to rotate in reverse so that the locking projection 11 enters the catch groove 203.

In the illustrated example, on each side of a pair of introduction cavities 202*f* formed in the cylinder front end of the main body part 202 of the inner part 20 for the locking projection 11 of the striker body 1, there is formed a cam surface 203*g* which has a slope that gradually retreats as it approaches the introduction cavity 202*f*. In the case that the inner part 20 rotates forward erroneously in a state in which the striker body 1 is not inserted inside the receiving part 201 of the inner part 20, that is, when the opening-and-closing moving body 3 is not moved to the stopped position, the locking projection 11 can strike the cam surface 203*g* of the inner part 20 moved backward by the forcing of the forcing device 22 by moving the opening-and-closing moving body 3 toward the stopped position.

Figure 10C:
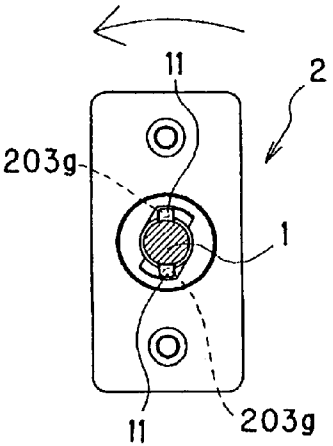
FIG. 10(*a*) is a sectional side view of the essential components of the locking device, FIG. 10(*b*) is a sectional plan view of the essential components, and FIG. 10(*c*) is a front view of the catcher body (2)
Figure 10A:
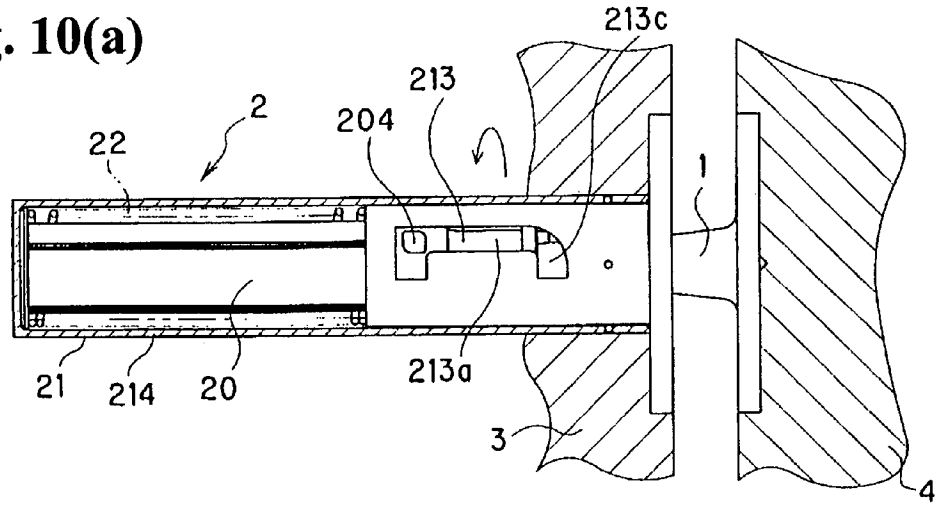
Figure 10B:
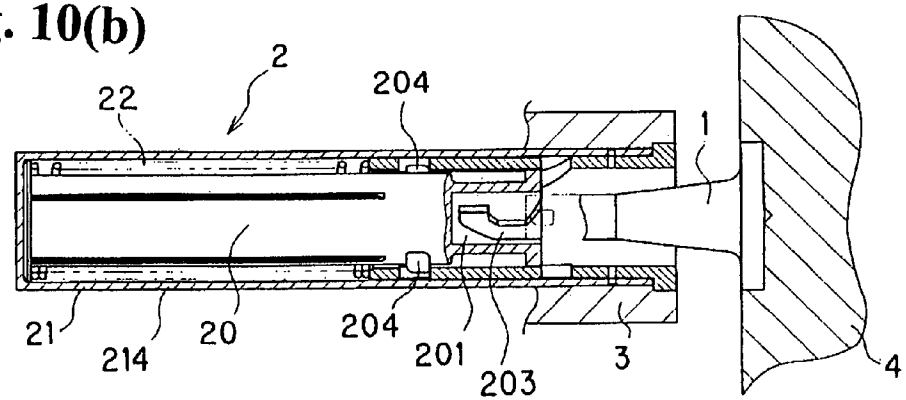
Figure 11C:
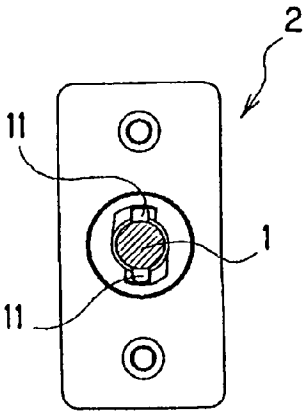
FIG. 11(*a*) is a sectional side view of the essential components of the locking device, FIG. 11(*b*) is a sectional plan view of the essential components, and FIG. 11(*c*) is a front view of the catcher body (2)
Figure 11A:
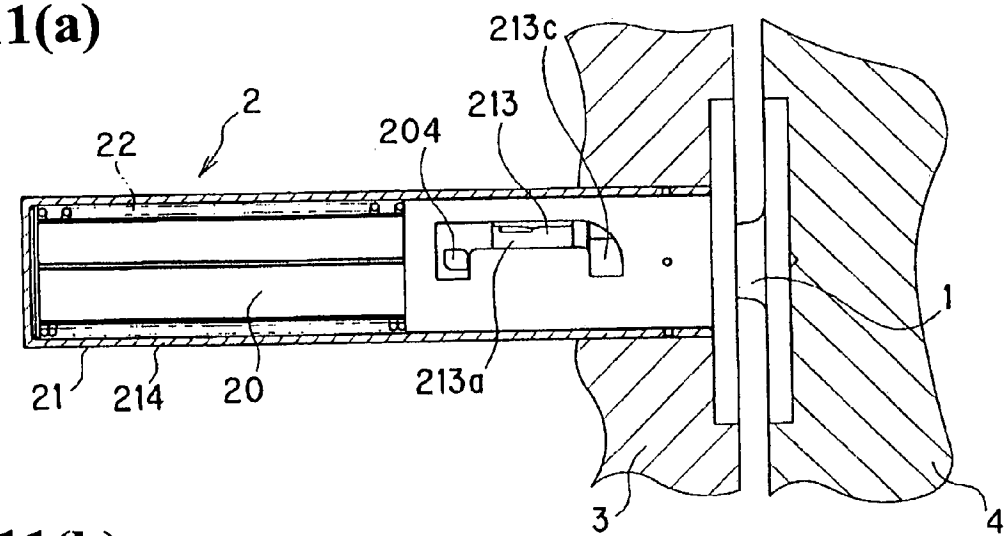
Figure 11B:
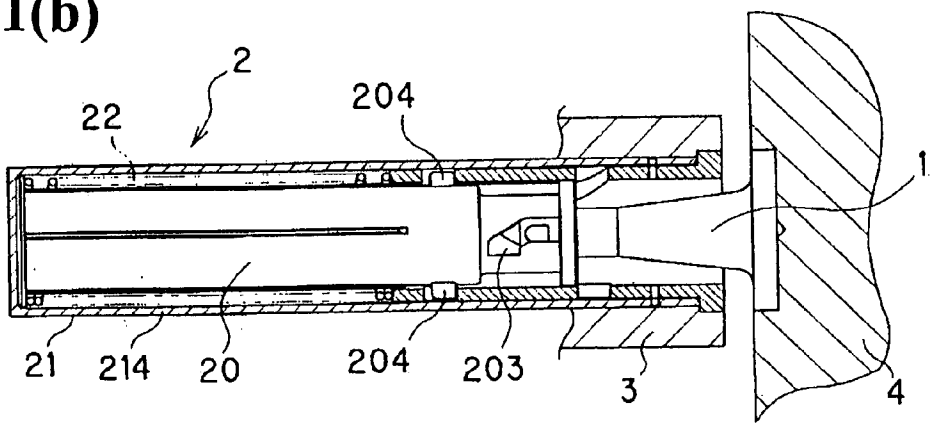
Figure 12C:
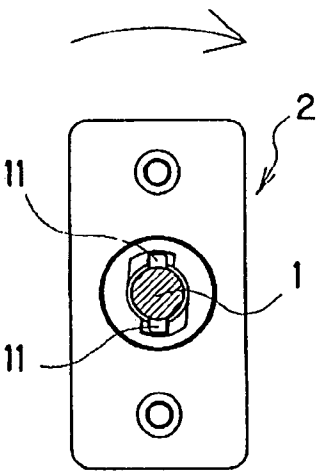
FIG. 12(*a*) is a sectional side view of the essential components of the locking device, FIG. 12(*b*) is a sectional plan view of the essential components, and FIG. 12(*c*) is a front view of the catcher body (2)
Figure 12A:
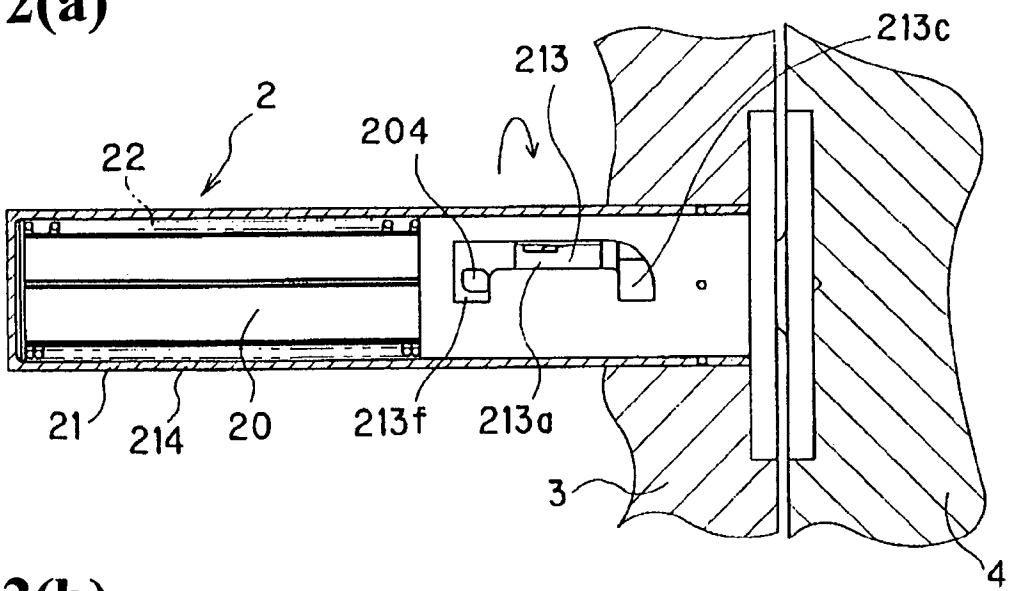
Figure 12B:
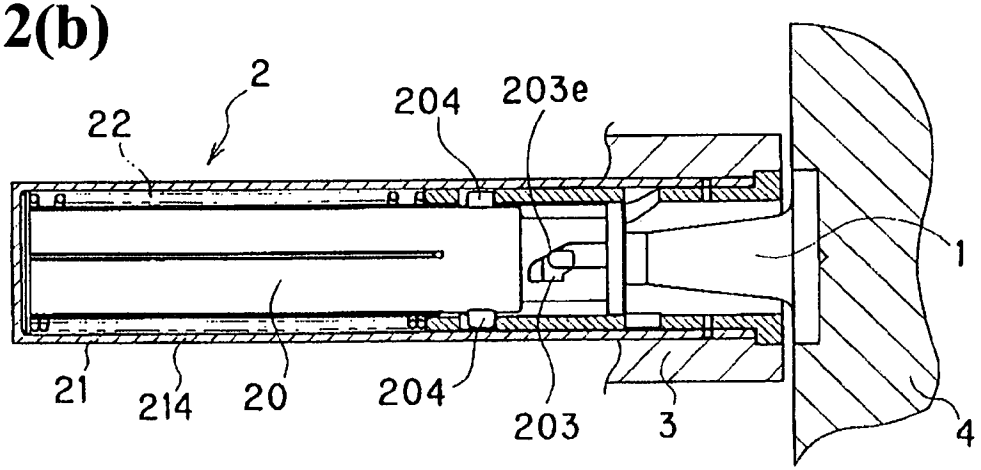

If the opening-and-closing moving body 3 is moved toward the stopped position from a state in which the inner part 20 is erroneously moved backward, the locking projection 11 of the striker body 1 is struck on the cam surface 203*g*, and the inner part 20 is rotated in reverse (FIGS. 10(*a*)–10(*c*)). By this, it becomes possible to make the locking projection 11 of the striker body 1 enter into the catch groove 203 (FIGS. 11(*a*)–11(*c*)). At this time, the lock projection 204.*of* the inner part 20 is positioned at the rear end of the lock groove 213. Because the rear side groove part 213*f* is formed at the rear end of the lock groove 213, this reverse rotation is not obstructed (FIGS. 11(*a*)–11(*c*)). When the locking projection 11 of the striker body 1 enters the catch groove 203, the locking projection 11 is pushed against the outer corner part 203*e* of the corner of the catch groove 203, the inner part 20 is rotated forward, the locking projection 11 is caught in the deep side groove part 203*c* of the catch groove 203, and a state being the same as when the striker body 1 is received by the catcher body 2 is produced correctly (FIGS. 12(*a*)–12(*c*) to FIGS. 13(*a*)–13(*c*)).

In this embodiment, the locking projections 11 are formed respectively on both the left and right sides of the striker body 1. In addition, the catch grooves 203, lock grooves 213, and lock projections 204 are formed respectively on one side and the other side of an imaginary plane including the central axial line of the inner part 20 following the longitudinal direction of this inner part 20.

In the illustrated example, the lock grooves 213 and lock projections 204 are formed on both sides of the first imaginary plane x including the central axial line of the inner part 20. The catch grooves 203 are formed on both sides of the second imaginary plane y orthogonal to this first imaginary plane x and including the central axial line of the inner part 20.

As a result, in this embodiment, the inner part 20 can be rotated forward smoothly accompanying the movement toward the stopped position of the opening-and-closing moving body 3. By moving the opening-and-closing moving body 3 toward the opening direction from the stopped position of the opening-and-closing moving body 3 having the striker body 1 coupled with the inner part 20 by this forward rotation, a state in which the inner part 20 is restored to the forward position while smoothly rotating the inner part 20 in reverse to release such coupling can be maintained.

The disclosure of Japanese Patent Application No. 2004-193351, filed on Jun. 30, 2004, is incorporated in the application.

While the invention has been explained with reference to the specific embodiments of the invention, the explanation is illustrative and the invention is limited only by the appended claims.

What is claimed is:

1. A locking device for locking an opening-and-closing moving body in a stopped position, comprising:

a striker body disposed on one of a striking part of the moving body and a struck part of a non-moving body hitting against the striking part of the moving body in the stopped position, and a catcher body disposed on the other of the striking part of the moving body and the struck part of the non-moving body, said catcher body including an inner part with a receiving part for receiving the striker body, an outer part for holding the inner part to be movable forward and backward and rotatable around a longitudinal axis of the inner part, a forcing device for urging the inner part in a backward direction that the inner part enters the outer part, and a damping device for damping the inner part moving in the backward direction, said forcing device urging the inner part to engage the outer part and stop when the inner part is situated in a forward position, said inner part being rotated by the striker body entering the receiving part of the inner part in the forward position when the moving body moves toward the stopped position so that the striker body is locked in the receiving part when the inner part is rotated and stopping of the inner part is released.

2. A locking device according to claim 1, wherein said striker body includes a shaft part extending in a direction that the moving body moves and a locking projection projecting from a side of the shaft part, said catcher body further includes a catch groove with an entrance groove part along a receiving direction that the striker body is received at the receiving part, and a deep side groove part with a corner at a connected portion thereof connected to a deep end of the entrance groove part and extending in a direction intersecting the receiving direction, one of said inner part and said outer part includes a lock groove having a straight groove part along a moving direction that the inner part moves and a front side groove part with a corner at a connected portion thereof connected to a front end of the straight groove part and extending in a direction intersecting the moving direction, the other of said inner part and said outer part having a lock projection inserted into the lock groove, said forcing device urging the inner part so that the lock projection engages the front side groove part when the inner part is situated in the forward position, and said inner part is rotated by the striker body entering the receiving part of the inner part in the forward position and the locking projection abuts against the corner of the catch groove so that the locking projection engages the corner of the catch groove and the lock projection enters the straight groove part when the opening-and-closing moving body moves toward the stopped position.

3. A locking device according to claim 2, wherein said lock projection is arranged to push the corner of the lock groove to rotate the inner part in reverse when the moving body moves toward an original position and the inner part moves toward a forward position while the locking projection of the striker body engages the deep side groove part of the catch groove in a backward position so that the locking projection is removed from the deep side groove part of the catch groove.

4. A locking device according to claim 3, wherein said receiving part of the inner part includes a cam surface on an entrance side of the entrance groove part of the catch groove for hitting the locking projection when the striker body abuts against the inner part after the inner part rotates forward and moves to a backward position through an erroneous operation so that the inner part rotates in reverse to insert the locking projection into the catch groove.

5. A locking device according to claim 2, wherein said locking projection includes locking projection portions formed respectively on two sides of the striker body, said catch groove including catch groove portions formed respectively on two sides of an imaginary plane including a central axial line of the inner part along a longitudinal direction of the inner part, said lock groove including lock groove portions formed respectively on the two sides of the imaginary plane, and said lock projection including lock projection portions formed respectively on the two sides of the imaginary plane.

6. A locking device according to claim 1, wherein said damping device includes a cylinder provided on one of the inner part and the outer part, a head part with an orifice for dividing an inner space of the cylinder into two parts, and a shaft part provided on the other of the inner part and the outer part for supporting the head part inserted into the cylinder so that a damping force is generated through fluid resistance of a fluid passing through the orifice when the inner part moves backward.

7. A locking device according to claim 6, said damping device further includes a flow channel for passing the fluid toward the orifice narrowing when the inner part moves at a higher speed.

* * * * *